United States Patent [19]

Hodges

[11] Patent Number: 5,058,165

[45] Date of Patent: Oct. 15, 1991

[54] SPEECH EXCITATION SOURCE CODER WITH CODED AMPLITUDES MULTIPLIED BY FACTORS DEPENDENT ON PULSE POSITION

[75] Inventor: Martin R. L. Hodges, Ipswich, England

[73] Assignee: British Telecommunications public limited company, Great Britain

[21] Appl. No.: 382,687

[22] PCT Filed: Dec. 29, 1988

[86] PCT No.: PCT/GB88/01152

§ 371 Date: Aug. 14, 1989

§ 102(e) Date: Aug. 14, 1989

[87] PCT Pub. No.: WO89/06418

PCT Pub. Date: Jul. 13, 1989

[30] Foreign Application Priority Data

Jan. 5, 1988 [GB] United Kingdom ..... 8800120
Jan. 29, 1988 [GB] United Kingdom ..... 8801998

[51] Int. Cl.[5] ..... G10L 3/02; G10L 9/14
[52] U.S. Cl. ..... 381/38; 381/36
[58] Field of Search ..... 381/31-38, 381/41, 43, 46; 364/513.5

[56] References Cited

U.S. PATENT DOCUMENTS

| | | | |
|---|---|---|---|
| Re. 32,580 | 1/1988 | Atal et al. | 381/40 |
| 4,724,535 | 2/1988 | Ono | 381/31 |
| 4,776,015 | 10/1988 | Takeda et al. | 381/41 |
| 4,821,324 | 4/1989 | Ozawa et al. | 381/31 |
| 4,864,621 | 9/1989 | Boyd | 381/38 |
| 4,873,724 | 10/1989 | Satoh et al. | 381/41 |
| 4,932,061 | 6/1990 | Kroon et al. | 381/31 |
| 4,944,013 | 7/1990 | Gouvianakis et al. | 381/38 |

OTHER PUBLICATIONS

Atal et al, IEEE International Conference on Acoustics, Speech and Signal Processing, vol. 1, May 1982, "A New Model of LPC Excitation for Producing Natural-Sounding Speech at Low Bit Rates", pp. 614-617.

Singhal et al., IEEE, "Improving Performance of Multi-Pulse LPC Coders at Low Bit Rates", 1984, pp. 1.3.1-1.3.4.

ICASSP '84 IEEE International Conference on Acoustics, Speech & Signal Processing, Mar. 19-21, 1984, San Diego, U.S., vol. 1, IEEE (New York, U.S.) M. Berouti et al: "Efficient Computation and Encoding of the Multipulse Excitation for LPC", pp. 10.1.1-10.1.4.

IEEE Journal on Selected Areas in Communications, vol. SAC-3, No. 2, Mar. 1985, IEEE (New York, U.S.) R. Sharma: "Architecture Design of a High-Quality Speech Synthesizer Based on the Multipulse LPC Technique", pp. 377-383.

*Primary Examiner*—Dale M. Shaw
*Assistant Examiner*—Michelle Doerrler
*Attorney, Agent, or Firm*—Nixon & Vanderhye

[57] ABSTRACT

Input speech is processed to derive LPC (Linear Predictive Coding) filter parameters and parameters of a multipulse excitation which are quantized prior to transmission along with the filter parameters to a decoder where the excitation is generated and drives an LPC filter to produce resynthesized speech. Prior to the quantization the pulse amplitudes are multiplied by factors which depend only on their position in the sequence in which the pulses are derived.

7 Claims, 1 Drawing Sheet

SPEECH EXCITATION SOURCE CODER WITH CODED AMPLITUDES MULTIPLIED BY FACTORS DEPENDENT ON PULSE POSITION

BACKGROUND OF THE INVENTION

1. Field of the Invention

The invention is concerned with speech coding, and more particularly to systems in which a speech signal can be generated by feeding the output of an excitation source through a synthesis filter. The coding problem then becomes one of generating, from input speech, the necessary excitation and filter parameters. LPC (linear predictive coding) parameters for the filter can be derived using well-established techniques, and the present invention is concerned with the excitation source.

2. Related Art

Systems in which a voiced/unvoiced decision on the input speech is made to switch between a noise source and a repetitive pulse source tend to give the speech output an unnatural quality, and it has been proposed to employ a single "multipulse" excitation source in which a sequence of pulses is generated, no prior assumptions being made as to the nature of the sequence. It is found that, with this method, only a few pulses (say 8 in a 10 ms frame) are sufficient for obtaining reasonable results. See B S Atal and J R Remde: "A New Model of LPC Excitation for producing Natural-sounding Speech at Low Bit Rates", Proc. IEEE ICASSP, Paris, pp. 614, 1982.

SUMMARY OF THE INVENTION

According to the present invention there is provided a speech coder comprising means for deriving, from an input speech signal, parameters of a synthesis filter; means for generating a coded representation of an excitation consisting of a plurality of pulses within a time frame corresponding to a larger plurality of speech samples, being arranged in operation to select the amplitudes and timing of pulses so as to reduce the difference between the input speech signal and the response of the filter to the excitation by:

deriving the amplitude and timing of a first pulse, which along represents an excitation tending to reduce the said difference, and successively deriving one or more further pulses which in combination with the first and any intervening pulses represent an excitation tending to reduce the said difference;

means for multiplying the pulse amplitudes by factors which depend only on their position in the derivation sequence; and a backward adaptive quantizer for quantizing the products.

BRIEF DESCRIPTION OF THE DRAWING

Some embodiments of the invention will now be described with reference to the accompanying drawings, in which.

DESCRIPTION OF PREFERRED EMBODIMENTS

Figure 1:
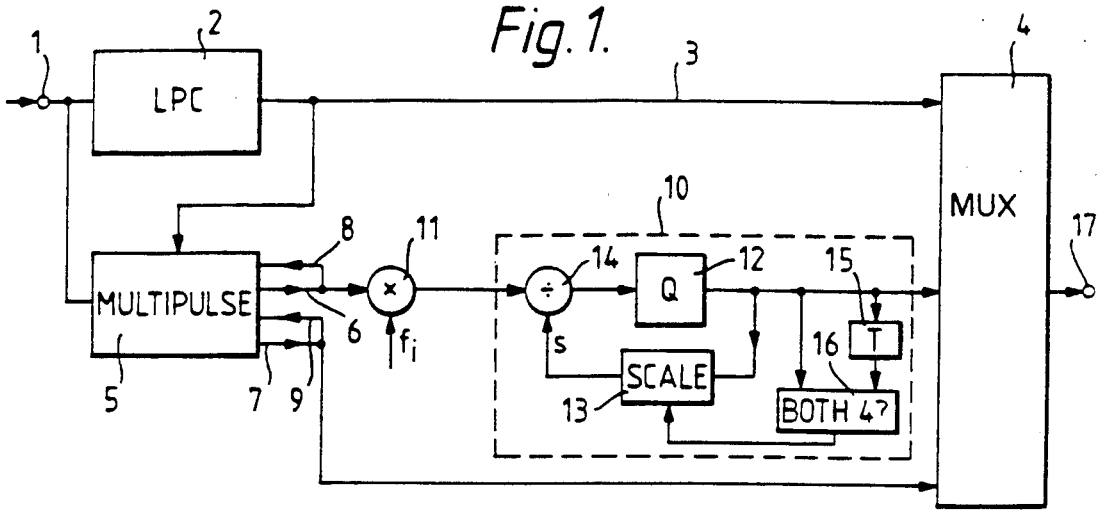
FIG. 1 is a block diagram of one embodiment of speech coder.

In the coder of FIG. 1, input speech signals, in sampled (preferably digital) form at an input 1 are processed by a predictor 2 to produce an output (e.g. in the form of a set of filter coefficients) defining a synthesis filter having a spectral response akin to that of the speech signals. The predictor analysis can be any of those conventionally used in so-called LPC (linear predictive coding) speech coders. As in common in such systems, the analysis is performed on frames of speech into which the input samples are divided. Typically the frame length may be 20 mns; hence a set of coefficients is produced every 20 mns and supplied via lines 3 to an output multiplexer 4.

As well as the filter representation, the coder also produces a representation of an excitation which is to be generated at the decoder to drive the synthesis filter in order to produce an approximation to the original speech. The coder of FIG. 1 has a multipulse derivation unit 5 which derives from the input speech samples and the LPC coefficients the amplitudes (on output 6) and positions (on output 7) of the pulses in a "multipulse" excitation frame as mentioned above. Whilst the typical sub-block (i.e. portion of LPC frame) size of 10 ms with eight pulses may be employed, the embodiment of FIG. 1 employs a sub-block duration of 4 ms, with three pulses. This is preferred as introducing less delay into the coding process. The object of the multipulse derivation is to find the pulse positions and amplitudes which minimize the error between the decoded synthetic speech and the original speech.

If it is assumed that a sub-block consists of n speech samples, this represents n input speech samples $S_0 \ldots S_{n-1}$ and n synthesised samples $S'_0 \ldots S'_{n-1}$, which can be regarded as vectors $\bar{s}$, $\bar{s}'$. The excitation consists of pulses of amplitude $a_m$ which are, it is assumed, permitted to occur at any of the n possible time instants within the frame, but there are only a limited number of them (say k). Thus the excitation can be expressed as an n-dimensional vector a with components $a_0 \ldots a_{n-1}$, but only k of them are non-zero. The objective is to find the 2 k unknowns (k amplitudes, k pulse positions) which minimise the error:

$$\hat{e}^2 = (\hat{s} - \hat{s}')^2 \qquad (1)$$

The amount of computation required to do this is considerable and the procedure proposed at Atal and Remde was as follows:

(1) Find the amplitude and position of one pulse, alone, to give a minimum error.

(2) Find the amplitude and position of a second pulse which, in combination with this first pulse, give a minimum error; the positions and amplitudes of the pulse(s) previously found are fixed during this stage.

(3) Repeat for further pulses.

This method is employed in a derivation unit 5 of FIG. 1; that the earlier derived pulses are taken into account in the later derivations within a sub-block is indicated in FIG. 1 by feedback paths 8, 9. Note that the sequence in which the pulses are derived is not related to their actual position within the sub-block.

The pulse amplitudes $a_i$ are passed via a backward-adaptive quantizer 10, described below. First however they are multiplied (in a multiplier 11) by a statistical factor $f_i$. In practice it is found that the first pulse to be dervied is generally the largest, and successively derived pulses tend to be progressively smaller, at least for the first few pulses. Although the pulse sizes vary, a statistical analysis on training sequences shows that on average this is so, and the multiplier 10 is supplied with factors such that on average the pulse amplitudes at the multiplier output tend to be the same irrespective of which pulse in the derivation sequence it is. For the case considered here of three pulses, the factors employed are:

first pulse to be derived $f_0=1$ second pulse to be derived $f_1=8/5$ third pulse to be derived $f_2=8/3$ (the fourth to sixth pulses, if present, may be given the factors 8/3, 8/3 and 4) the object of this step is to make the adaptive quantization more efficient and enable either the quantization noise or the number of bits used to encode the amplitudes (or both) to be reduced.

Where larger numbers of pulses are used, suitable factors can be derived by analysis of sample sequences of speech to find the average magnitudes of the pulses compared with that of the first derived pulse. The multiplication factor is then the reciprocal of this. A simple (albeit non-optimum) approach for such a situation is to use a factor of unity for the first derived pulse, and 2 for the remainder.

The adaptive quantizer 10 is a 3-bit, Jayant quantizer and has a optimum non-linear Max quantizer 12 having the following characteristic:

TABLE 1

| INPUT RANGE | OUTPUT | OUTPUT CODE |
|---|---|---|
| below −1.748 | −2.152 | 1/4 |
| −1.748 to −1.5 | −1.344 | 1/3 |
| −1.5 to 0.50006 | −0.7560 | 1/2 |
| −0.50006 to 0 | −0.2451 | 1/1 |
| 0 to 0.50006 | 0.2451 | 0/1 |
| 0.50006 to 1.5 | 0.7560 | 0/2 |
| 1.5 to 1.748 | 1.344 | 0/3 |
| above 1.748 | 2.152 | 0/4 |

The output code simply represents the values of the three output bits—the number before the "/" is the sign bit and the number 1 . . . 4 following signifies the binary number 0 . . . 11.

A scaling unit 13 provides a scale factor to a divider 14 at the quantizer input. The scale factor s (initially unity) is varied in that, depending on the quantizer codeword output for a given pulse amplitude value, the scale factor s is increased or decreased from its current value to a new value to be used for the next pulse amplitude, $$S_k m = S_{k-1} \cdot m_{k-1}$$

Where m is given by:

TABLE 2

| output code | m |
|---|---|
| 1 | 0.875 |
| 2 | 0.875 |
| 3 | 1.000 |
| 4 | 1.500 |

Note that these factors are different from those proposed by Jayant; also that the scale factor is not reset at the end of a sub-block or frame.

An additional feature that may be employed for speeding up adaption is that, if two consecutive output codes have the value 4, then the second occurrence results in an increase of scale factor by a factor of 2.25 (i.e. two increases of 1.5). This is illustrated in frame 1 by a delay 15 and 4,4 detector 16.

The output multiplexer receives the quantised amplitudes from the quantizer 9 and the position information from the derivation unit 5, as well as the LPC coefficients and combines these into a single output 17.

Figure 2:
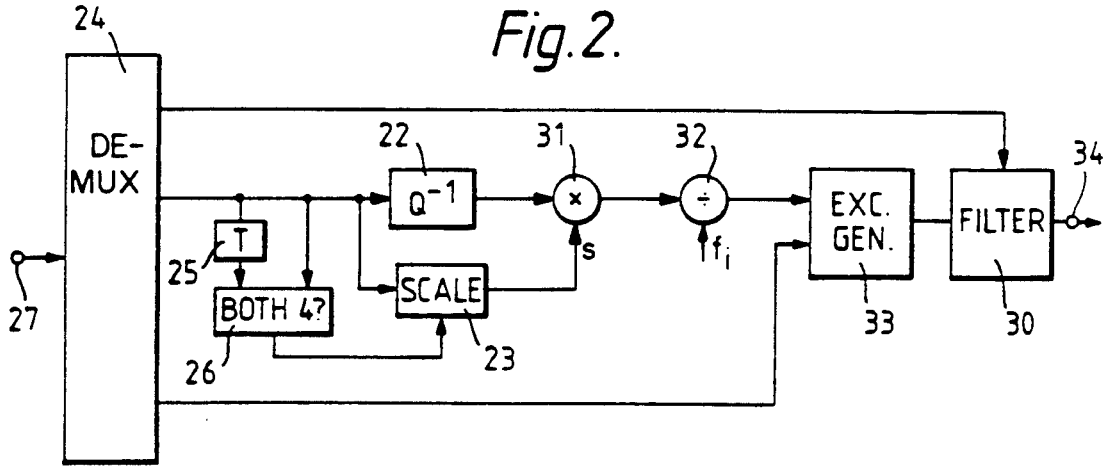
FIG. 2 is a block diagram of a decoder for use with the coder of FIG. 1.

A decoder is shown in FIG. 2, where a demultiplexer 24 separates the coefficients, amplitudes and position information and feeds the coefficients to update a synthesis filter 30. The pulse amplitude codewords are passed via an "inverse quantizer" 22 which removes the nonlinearity introduced by the quantizer 10—i.e. it converts the received codewords into the values given in the middle column of table 1. The scaling factor s is obtained from the amplitude codewords by units 23, 25, 26 in all respects identical to units 13, 15, 16 of FIG. 1 and the inverse quantizer output is multiplied by s in a multiplier 31. The factors $f_i$ are then applied to a divider 32 whose output represents the original amplitudes (but with quantization error) and is supplied along with the pulse position information to an excitation generator 33.

The output of the excitation generator 33 is filtered by the filter 30 to produce decoded speech at an output 34.

Figure 3:
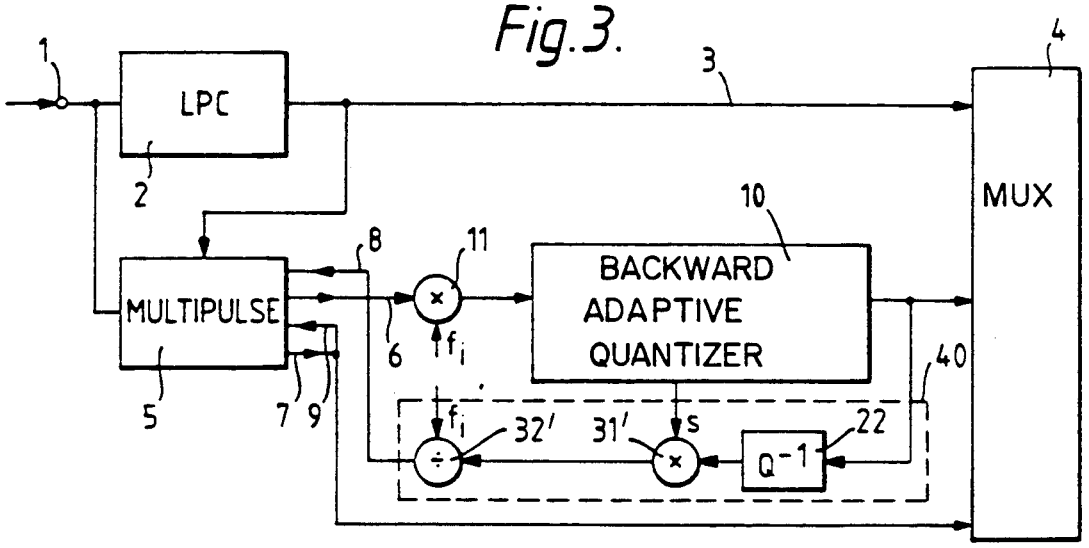
FIG. 3 is a block diagram of a second embodiment of coder.

It has already been mentioned that the multipulse derivation unit take account, in the later pulse derivations, of the effect of the earlier derived pulses, via the feedback paths 8,9. It is preferable to take account of the actual effect of these pulses at the decoder and therefore the quantization is preferably included within this loop. Thus, in the modified coder shown in FIG. 3, the pulse amplitudes are fed back from the output via a local decoder 40 which has an inverse quantizer 22', multiplier 31', and divider 32'. The scale factor can be obtained from the quantizer 10, of course. The decoder of FIG. 2 may again be used with this coder.

Some multipulse coding schemes involving sequential pulse derivation involve reoptimization steps. This is because the earlier derived pulses are derived without reference to the nature of those derived later, and the results can be improved by applying a correction to the amplitudes and/or positions of the pulses. See, for example out UK patent applications nos. 8608031 and 8720604 corresponding to U.S. patent application Ser. Nos. 06/846,854 and 07/187,533 respectively).

In the case of FIG. 1, any of these techniques may be applied as in the past. In the case of FIG. 2, position reoptimization may be used, if desired. However, in FIG. 3, where in-loop quantization is employed this implies that quantization of pulse i is carried out before pulse i=1 is derived, and further adjustment of pulse i may not then be possible without seriously affecting the quantization process.

I claim:

1. A speech coder comprising:

means for deriving, from an input speech signal, parameters of a synthesis filter;

means for generating coded output signals representing an excitation for said synthesis filter, said output coded signal defining a plurality of pulses having respectively corresponding pulse amplitudes and times of occurrence within a time frame corresponding to a larger plurality of speech samples, the amplitudes and timing of said plurality of pulses being selected so as to reduce the difference between the input speech signal and the response of said synthesis filter to the excitation by:

deriving the amplitude and timing of a first pulse, which alone represents an excitation tending to reduce the said difference, and successively deriving one or more further pulses which in combination with the first and any intervening pulses represent an excitation tending to reduce the same difference;

means for multiplying the pulse amplitudes by factors which depend only on their position in the derivation sequence; and a backward adaptive quantizer for quantizing the resulting products to produce said coded output signals.

2. A speech coder according to claim 1 in which at least three pulses are derived.

3. A speech coder according to claim 2 in which the factors are unity for the first pulse and, for each succeeding pulse, greater than unity and greater than or equal to the factor used for the just-preceding derived pulse.

4. A speech coder according to claim 3 in which the factors for the first three pulses in order of derivation are approximately 1, 8/5 and 8/3.

5. A speech coder according to claim 1 in which the deriving means employ the values of the amplitudes of the first and any intervening pulses obtained from the quantizer output via a decoder included as part of the speech coder.

6. A method for generating and transmitting coded signals representative of input speech signals, said method comprising the steps of:

generating first signals representing speech linear predictive coding synthesis filter excitation pulse amplitudes and positions;

scaling said first signals representing pulse amplitudes by predetermined respectively corresponding scale factors to produce coded output signals also representative of said generated first signals representing pulse amplitudes but having a reduced dynamic range; and quantizing and transmitting said coded output signals with reduced dynamic range.

7. Apparatus for generating and transmitting coded signals representative of input speech signals, said apparatus comprising:

means for generating first signals representing speech linear predictive coding synthesis filter excitation pulse amplitudes and positions:

means for scaling said first signals representing pulse amplitudes by predetermined respectively corresponding scale factors to produce coded output signals also representative of said generated first signals representing pulse amplitudes but having a reduced dynamic range; and means for quantizing and transmitting said coded output signals with reduced dynamic range.

* * * * *